United States Patent [19]

Keller

[11] Patent Number: 4,703,690

[45] Date of Patent: Nov. 3, 1987

[54] DEVICE FOR PRE-EMULSIFYING OF INK EMULSION IN OFFSET PRINTING APPARATUS

[75] Inventor: Heinz Keller, St. Gallen, Switzerland

[73] Assignee: Ferd Buesch AG, Switzerland

[21] Appl. No.: 887,553

[22] Filed: Jul. 17, 1986

[30] Foreign Application Priority Data

Jul. 19, 1985 [DE] Fed. Rep. of Germany ..... 3525794

[51] Int. Cl.[4] ..... B41F 7/02; B41F 7/24

[52] U.S. Cl. ..... 101/142; 101/148

[58] Field of Search ..... 101/148, 147, 132.5, 101/137, 142, 143, 144, 137, 145, 217

[56] References Cited

U.S. PATENT DOCUMENTS

| | | | |
|---|---|---|---|
| 3,645,202 | 2/1972 | Cake | 101/350 X |
| 4,211,167 | 7/1980 | Corse | 101/148 |
| 4,407,197 | 10/1983 | Jeschke | 101/148 |

*Primary Examiner*—J. Reed Fisher

*Attorney, Agent, or Firm*—Kenyon & Kenyon

[57] ABSTRACT

In an offset printing apparatus one arranges in the "channel" of the printing plate cylinder a further segment for improving the emulsion and for reducing the time-interval between "stripping" and "scumming," which is provided with a plane, water-conducting and ink-repellent plate, preferably of polished chromium steel. In the course of the rotation of the printing plate cylinder, this segment, designated preemulsifying segment, is wetted by the dampening form-roller of the dampening unit with water which is emulsified by contact with the subsequently arranged ink form-rollers, before same come in contact with the printing plate of the printing plate segment.

As a result of the arranging of the emulsifying segment, the time-interval between "stripping" and "scumming" can be quadrupled and the amount of water required can be reduced.

3 Claims, 1 Drawing Figure

DEVICE FOR PRE-EMULSIFYING OF INK EMULSION IN OFFSET PRINTING APPARATUS

Figure 1:
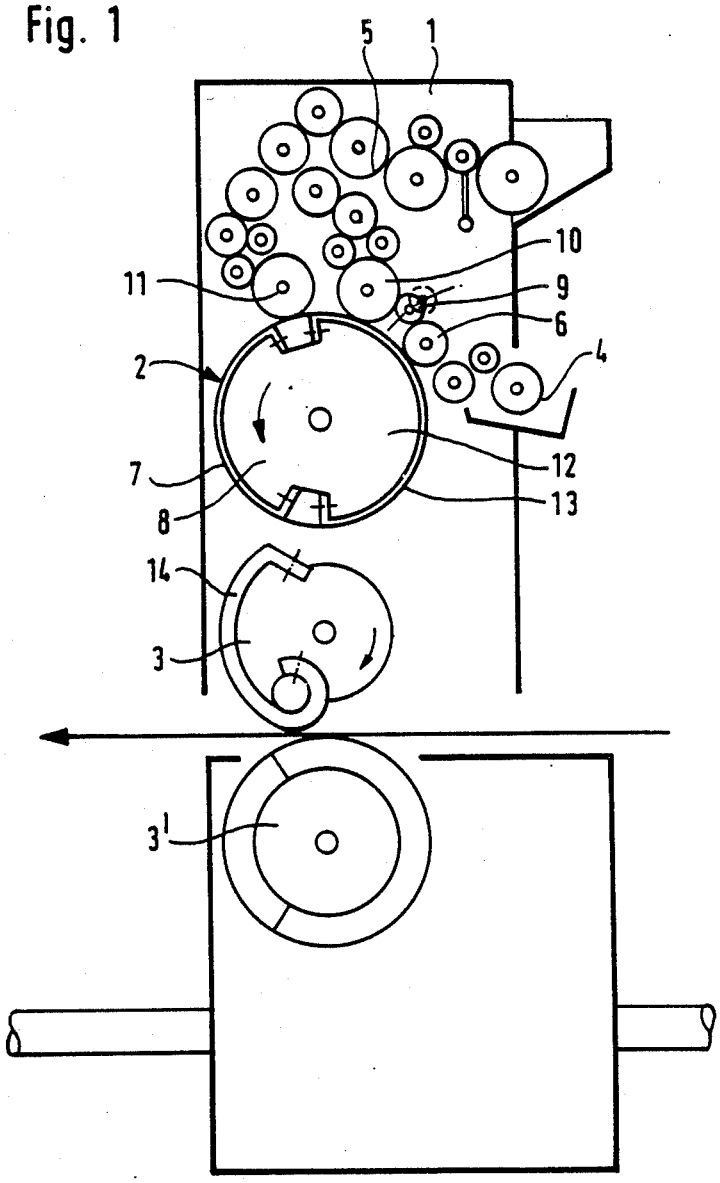

The invention relates to a device for the pre-emulsifying of the ink emulsion in offset printing apparatus for variable sizes, which consists of a dampening unit for the supply of water and an inking unit that are arranged around a printing plate cylinder provided with a printing segment.

In offset printing, the quality of the print depends essentially on that the emulsion between ink and water needed for the releasing and separating of the ink be as much as possible homogeneous and remain also homogeneous during the printing process. In offset printing, with devices known in the art, the printing plate is regularly provided via form-rollers of a so-called dampening unit with a thin water film on which, upon further rotation of the cylinder, ink is applied by a plurality of ink form-rollers. An emulsification between water and ink is however possible in practice only if, following the first application of water, and the first application of ink by the first form-roller, onto the printing segment, additional form-rollers exist that do apply not only additional ink, but bring about an emulsification above all else also by way of distribution.

With offset printing apparatus for variable sizes, in particular when same are used in printing presses with intermittent feed or printing apparatus with reduced-size inking units, it has become the standard practice to limit the circumference of the printing plate segment to the circumference of the rubber blanket-segment of the printing cylinder. As a result, by comparison with offset printing apparatus with full-size cylinders, the roller-contact circumference required for emulsification is reduced substantially.

It has been attempted to bring about a pre-emulsification in that one applies water onto the printing segment via dampening form-rollers not only from the dampening unit, but, additionally, transfers water additionally via a transfer roller from the dampening form-roller onto the first inking roller. Since, as a result of the slight contact of the water transfer roller with the first inking roller, one emulsifies only little, there results the drawback that the first ink form-roller that should normally transfer 70% of the ink is capable of transferring substantially less ink. Therefore, the arranging of a large number of additional ink form-rollers is necessary in order, on the one hand, to transfer sufficient ink and, on the other, to emulsify sufficiently. As a result of the increasing number of form-rollers, the inking unit is therefore enlarged substantially, which is extraordinarily uneconomical. Under certain circumstances it is furthermore difficult to arrange a large number of ink form-rollers around the printing cylinder.

It is furthermore known in the art that the amount of water to be supplied in offset printing cannot be controlled uniformly, especially not if the other components that affect the degree of emulsion and the water ink ratio fluctuate constantly. In practice, a uniform emulsion, and hence a uniform supply of water, can be achieved only, if one prints from a full-size cylinder with an absolutely uniform printing image and if the ambient conditions as a whole do not change in any way during the printing cycle. For instance, there must not occur any change in the evaporation conditions of the water as a result of increasing heat-up produced by rolling friction in the inking unit and the dampening unit and the printing apparatus as a whole. Moreover, there must not occur any change in the water transfer into the inking unit up into the ink fountain, which can however not be prevented, because, as a result of the separation of the ink- and water-film upon every contact between two rollers, water is necessarily carried back into the inking unit up into the ink fountain. This takes place in the form of surface water. This surface water does however conversely also return again in part with the ink from the ink fountain. On account of water in the ink—and even if this is only surface water—the transfer of ink from the ink fountain up to the form-roller is of course upset again, i.e., the amount of ink is reduced which ought to result in turn in a reduction of the water supply via the dampening unit. The emulsion ratio becomes then however completely mixed up, if one operates with one printing segment only, in other words, if an emulsification between water and ink takes place only along a certain section of the printing cylinder. Moreover, the emulsion ratio is of course altered also by the fact that differential amounts of water or emulsion are absorbed by the printing segment depending on the change of the water-conducting and water-repellent areas on the plate. The consequence of these conditions is that the printer can control the amount and the point in time of the water supply via the dampening unit empirically only. The more nonuniform the water supply, the greater the changes and fluctuations in the degree of emulsion. However, the greater the respective fluctuation, the greater in turn is the need for the printer to control the water supply. However, the greater the need to exert control in spurts, the greater become in turn the fluctuations in the degree of emulsion, which leads eventually with regard to the printing result to having the emulsion fluctuate constantly between "stripping" (too mcuh water) and "scumming" or "greasing" (too little water), until it is eventually altogether impossible to achieve any uniform printing result whatsoever.

Finally, there is known in the art a so-called "reduced-size inking unit" with only one ink form-roller and one dampening form-roller at the large circumference of which there is arranged a plurality of "mirror" rollers. The "mirror" rollers have admittedly the advantage that, after the release of the ink from the ink form-roller onto the printing segment, the relief that remained on the ink form-roller is evened out. Disadvantageous is, however, that outside the contact with the printing plate cylinder, no water is supplied by the dampening form-roller to the ink form-roller. As a result, the emulsion is deteriorated substantially during the contactless partial revolution of the ink form-roller owing to the marked evaporation of water from the ink form-roller and the "mirror" rollers.

The aforementioned phenomena are additionally affected by the ink used and the stock used. Upon the use of well-emulsifying ink or well-emulsifiable ink and an absorbable stock, the emulsion fluctuations are compensated for relatively well. In the case of a stock that is practically incapable of absorbing any water, such as, for instance, sheet-metal or plastic materials or coated papers, the fluctuations in the management of the water in the emulsion are very marked. If one uses an ink, such as, for instance, an ultraviolet ink, which is per se difficultly emulsifiable, the fluctuation ranges become greater yet.

It is the object of the invention with simple means and without any increase in the number of the ink form-rollers and, thereby, the enlargement of the inking unit, with rotary printing apparatus with intermittent print or with rotary offset printing machines to obviate or to reduce the fluctuation range in time of the degree of emulsion and the build-up of this effect caused by environmental factors. This can, be achieved, as stated already above, in that the emulsification is improved.

An improvement of the emulsification during the printing and the attendant stabilization of the degree of emulsion is brought about according to the invention in that in the case of a cylinder provided with a printing segment, the part of the cylinder that is not covered by the plate, in other words, the so-called "channel" that does normally never come in contact with the dampening and ink form-rollers of the dampening unit and the printing unit, is provided with an additional segment referred to as pre-emulsifying segment. The pre-emulsifying segment is covered with a plate that is a standard, in other words, water-conducting, offset printing plate that is not provided with a printing image.

Preferably, it is a chrome-plated plate; one can however use also any other offset plate. What is essential is only that the surface be absolutely plane. One thereby achieves that, after the application of the ink onto the printing plate of the printing segment, upon the passage of the pre-emulsifying segment, whose surface is water-conducting and ink-repellent, there is supplied, on the one hand, additional water to the ink form-rollers and, since no ink reaches the pre-emulsifying segment from the ink form-rollers, the water supplied is emulsified with the ink present on the ink form-rollers so that, upon the subsequent passage of the printing segment, a good emulsion is transferred from the ink form-rollers without any reduction of the ink percentage. With experiments known in the art to increase the water percentage, in which water is transferred constantly onto the first ink form-roller not only via the dampening roller, but also a water transfer roller, the desirable ink transfer percentage of 70% at the first form-roller drops substantially, which would make necessary the arranging of additional ink form-rollers.

It is furthermore possible to provide the printing plate cylinder over its entire circumference with a plate made of chromium steel on which the printing image is arranged by coating, and the uncoated circumference of the printing plate serves as a pre-emulsifying segment.

The major advance over the methods known in the art lies above all else in the simple engineering arrangement that is extraordinarly economical since the arranging of another segment on the printing cylinder, or the extension of the printing plate over the entire circumference, causes practically no expense, whereas the substantial improvement of the emulsification between water and ink during the printing process does result in significant industrial benefits.

For the purpose of explaining the invention further, reference is had to the exemplified embodiment illustrated in the annexed drawing.

FIG. 1 shows a schematic representation of a rotary offset printing apparatus that is arranged with an intermittently operating printing machine with a plurality of printing mechanisms.

The offset printing apparatus 1 consists of a plate cylinder 2 and a printing cylinder 3 with a counter-pressure cylinder 3', as well as of the dampening unit 4 and the inking unit 5.

Around the plate cylinder 2 there are arranged, in the direction of rotation, the dampening unit 4 and the inking unit 5.

From the dampening unit 4 water is transferred by a dampening form-roller 6 onto the printing plate 7, when the segment 8 is in contact therewith. The dampening form-roller 6 is furthermore in contact with the first ink form-roller 10 via a disengageable transfer roller 9 in order to be able, if need be, to supply water additionally to the ink form-roller 10.

The inking unit 5 consists in standard manner of a vibrator roller and a plurality of transfer and distribution rollers, as well as a second ink form-roller 11.

According to the invention, on the plate cylinder 2, whose printing segment takes up approximately 130°, there is arranged in the area of the free part, the so-called "channel," another segment, the so-called pre-emulsifying segment 12 that is provided with a plane plate 13 made of polished chromium steel.

During the printing, the water-conducting and ink-repellent pre-emulsifying segment 12 with its plate 13 is first wetted with water by the dampening form-roller 6, and the water is emulsified with ink on the ink form roller 10. Then, the pre-emulsifying segment 12 gets under the second ink form-roller 11 whose ink is distributed further by contact with the pre-emulsifying segment 12 and is emulsified with any water that is possibly still present. A transfer of ink to the chromium plate 13 does not occur.

In the course of the further rotation of the printing plate cylinder 2, the printing segment 8 with the printing plate 7 comes then in contact with the dampening form-roller 6 and the ink form-rollers 10 and 11 as a result of which the ink emulsion that is already well emulsified by the pre-emulsifying segment is emulsified further and transferred. From the printing plate 7 the ink emulsion image is then transferred to the rubber printing blanket 14 of the printing cylinder 3 and from there onto the web of stock running between the printing cylinder 3 and the counterpressure cylinder 3'.

Studies have shown that as a result of the arrangement of the preemulsifying segment 12 it was possible to quadruple the time-interval between the disappearance of "stripping" until "scumming." Experimentally, an inking unit was saturated with water until "stripping" was produced. In continuing to print, only the water supply was interrupted to determine after how many revolutions (prints) there occurs "plugging up" (toning) of the printing plate. Without the pre-emulsifying segment 12 it was necessary to readjust the dampening unit setting for continued printing after about 4 minutes with about 230 prints. With the pre-emulsifying segment, the time-interval amounted to almost 16 minutes with approximately 800 prints, before it was necessary to readjust the dampening unit. Moreover, it was found that the water supply as a whole could be reduced.

I claim:

1. Device for the pre-emulsifying of the ink emulsion with offset printing apparatus for variable sizes, comprising a printing cylinder (3) and a counterpressure cylinder (3'), and a printing plate cylinder (2), around which there is arranged a dampening unit (4) with a dampening formroller (6) with a disengageable transfer roller (9) to a first ink formroller (10), and an inking unit (5) with vibrator, transfer, and distribution rollers, and a second ink form-roller (11) and, on the printing plate cylinder (2), a printing segment (8) with a printing plate (7), characterized in that in the free portion of the printing plate cylinder (2) there is arranged a pre-emulsifying segment (12) that is provided with a plane, water-conducting and ink-repellent plate (13).

2. Device according to claim 1, characterized in that the printing segment 8 encompasses 130° of the cylinder circumference.

3. Device according to claim 1, characterized in that the plane plate (13) consists of polished chromium steel.

* * * * *